US007814879B2

(12) United States Patent
Brower et al.

(10) Patent No.: US 7,814,879 B2
(45) Date of Patent: Oct. 19, 2010

(54) MONOLITHIC BLOCK AND VALVE TRAIN FOR A FOUR-STROKE ENGINE

(75) Inventors: David R. Brower, Townville, SC (US); Nagesh S. Mavinahally, Anderson, SC (US); Danny C. King, Anderson, SC (US); Brian M. Leinonen, Anderson, SC (US); Philip T. Scott, Anderson, SC (US); Michael W. Scrimager, Sterling Heights, MI (US); Anthony S. Thomas, Anderson, SC (US); Deng Dian Bo, Chongqing (CN); Bill Yang Ming, NanWai DaXian (CN)

(73) Assignee: Techtronic Outdoor Products Technology Limited, Hamilton (BM)

( * ) Notice: Subject to any disclaimer, the term of this patent is extended or adjusted under 35 U.S.C. 154(b) by 358 days.

(21) Appl. No.: 12/107,956

(22) Filed: Apr. 23, 2008

(65) Prior Publication Data

US 2009/0266330 A1 Oct. 29, 2009

(51) Int. Cl.
*F02B 75/22* (2006.01)
*F01L 1/02* (2006.01)

(52) U.S. Cl. ..... 123/195 R; 123/90.31; 29/888.06

(58) Field of Classification Search ..... 123/195 R, 123/311, 90.27, 90.31; 29/888.01, 888.06
See application file for complete search history.

(56) References Cited

U.S. PATENT DOCUMENTS

| | | | | |
|---|---|---|---|---|
| 2,218,332 | A | 10/1940 | Fowler | |
| 2,489,150 | A | 11/1949 | McCoy | |
| 2,740,393 | A | 4/1956 | Hoffman | |
| 3,191,618 | A | 6/1965 | McKim | |
| 3,561,416 | A | 2/1971 | Kiekhaefer | |
| 3,973,548 | A | 8/1976 | Celli | |
| 3,983,852 | A | 10/1976 | Chatourel | |
| 4,092,958 | A | 6/1978 | Hale | |
| 4,394,850 | A | 7/1983 | Hayashi | |
| 4,419,801 | A | 12/1983 | Yamashita et al. | |
| 4,434,756 | A | 3/1984 | Nilsson et al. | |
| 4,446,828 | A | 5/1984 | Bauder et al. | |
| 4,513,702 | A * | 4/1985 | Koga et al. | 123/193.5 |
| 4,549,507 | A | 10/1985 | Baumhardt | |
| 4,584,973 | A | 4/1986 | Dluhosch et al. | |
| 4,630,345 | A | 12/1986 | Lutz | |

(Continued)

FOREIGN PATENT DOCUMENTS

DE 100 32 845 8/2001

(Continued)

OTHER PUBLICATIONS

U.S. Appl. No. 11/655,486, filed Jan. 19, 2007, Brower et al.

*Primary Examiner*—Noah Kamen
(74) *Attorney, Agent, or Firm*—Michael Best & Friedrich LLP

(57) ABSTRACT

A cylinder crankcase for a four-stroke engine is disclosed. The cylinder crankcase includes a cylinder head, cylinder block, and crankcase which are monolithic. A half-crank crankshaft bears in a crank arm, which is included in the crankcase. The cylinder crankcase includes a belt driven valve train and crank arm that includes a pocket containing a crank gear attached to the crankshaft for driving the belt.

22 Claims, 8 Drawing Sheets

U.S. PATENT DOCUMENTS

| | | | |
|---|---|---|---|
| 4,630,579 | A | 12/1986 | Atkin |
| 4,632,169 | A | 12/1986 | Osborn et al. |
| 4,644,911 | A | 2/1987 | Hidaka et al. |
| 4,700,480 | A | 10/1987 | Rangert et al. |
| 4,712,517 | A | 12/1987 | Anno et al. |
| 4,856,486 | A | 8/1989 | Mori et al. |
| 4,873,945 | A | 10/1989 | Tamba et al. |
| 4,893,597 | A | 1/1990 | Kandler |
| 4,905,642 | A | 3/1990 | Suzuki et al. |
| 4,958,599 | A | 9/1990 | Yokoyama et al. |
| 4,977,863 | A | 12/1990 | Kronich |
| 4,984,539 | A | 1/1991 | Shinoda et al. |
| 5,000,244 | A | 3/1991 | Osborne |
| 5,016,584 | A | 5/1991 | Inoue et al. |
| 5,029,393 | A | 7/1991 | Nagashima et al. |
| 5,107,809 | A | 4/1992 | Suh |
| 5,217,059 | A | 6/1993 | Kuhn et al. |
| 5,230,314 | A | 7/1993 | Kawahara et al. |
| 5,357,921 | A | 10/1994 | Katoh et al. |
| 5,370,087 | A | 12/1994 | Guimond et al. |
| 5,419,037 | A | 5/1995 | Bailey |
| 5,469,821 | A | 11/1995 | Gosch |
| 5,676,105 | A | 10/1997 | Schwaderlapp et al. |
| 5,755,028 | A | 5/1998 | Takami et al. |
| 5,901,679 | A | 5/1999 | Tanaka et al. |
| 5,954,113 | A | 9/1999 | Buchborn |
| 5,988,120 | A | 11/1999 | Betsch et al. |
| 6,076,494 | A | 6/2000 | Kampichler et al. |
| 6,109,221 | A | 8/2000 | Higgins et al. |
| 6,119,648 | A | 9/2000 | Araki |
| 6,129,057 | A | 10/2000 | Langer |
| 6,158,400 | A | 12/2000 | Collie et al. |
| 6,250,273 | B1 | 6/2001 | Ryu et al. |
| 6,330,871 | B1 | 12/2001 | Jufuku et al. |
| 6,363,618 | B1 | 4/2002 | Dürr |
| 6,418,903 | B2 | 7/2002 | Müller et al. |
| 6,543,405 | B2 | 4/2003 | Sachdev et al. |
| 6,612,275 | B2 | 9/2003 | Immel et al. |
| 6,640,766 | B2 | 11/2003 | Furuya et al. |
| 6,662,773 | B2 | 12/2003 | Bauder |
| 6,675,763 | B1 | 1/2004 | Ratzi et al. |
| 6,810,849 | B1 | 11/2004 | Hirsch et al. |
| 6,904,883 | B2 | 6/2005 | Snyder et al. |
| 6,941,914 | B2 | 9/2005 | Snyder et al. |
| 6,971,362 | B2 | 12/2005 | Gunji et al. |
| 6,973,954 | B2 | 12/2005 | Ward |
| 7,073,476 | B2 | 7/2006 | Yamamura et al. |
| 7,073,490 | B2 | 7/2006 | Hoffmann et al. |
| 7,077,089 | B2 | 7/2006 | Hudak |
| 7,086,389 | B2 | 8/2006 | Yamada |
| 7,104,258 | B2 | 9/2006 | Yamada et al. |
| 7,243,632 | B2 | 7/2007 | Hu |
| 2005/0121004 | A1 | 6/2005 | Yamada et al. |
| 2005/0166395 | A1 | 8/2005 | Millerman |
| 2005/0235944 | A1 | 10/2005 | Michioka |
| 2005/0279315 | A1 | 12/2005 | Yamamura et al. |
| 2006/0048386 | A1 | 3/2006 | Boehm et al. |
| 2006/0096567 | A1 | 5/2006 | Henkel |
| 2007/0143996 | A1 | 6/2007 | Michioka |

FOREIGN PATENT DOCUMENTS

| | | |
|---|---|---|
| EP | 0486 463 | 5/1992 |
| EP | 0 657 234 | 8/1994 |
| EP | 0 887 130 | 12/1998 |
| EP | 1 227 237 | 7/2002 |
| GB | 1522219 | 11/1975 |
| GB | 2168109 | 6/1986 |
| GB | 2273967 | 7/1994 |
| GB | 2284858 | 6/1995 |
| JP | 6-87614 | 12/1994 |
| WO | WO 95/16121 | 6/1995 |
| WO | WO 98/26171 | 6/1998 |
| WO | WO 00/35743 | 6/2000 |

* cited by examiner

MONOLITHIC BLOCK AND VALVE TRAIN FOR A FOUR-STROKE ENGINE

BACKGROUND

The present invention relates generally to internal combustion engines, and, in particular, to cylinder crankcase assemblies for four-stroke engines.

Previously, small hand-held lawn and garden implements, chainsaws, and small vehicles were often powered using two-stroke engine technology. However, due to increasingly stringent environmental emission controls, the use of four-stroke engines in these appliances and vehicles has become more common. Unlike two-stroke engines, four-stroke engines do not supply fresh fuel to the combustion chamber while also scavenging the combustion products from the previous stroke. Therefore, four-stroke engines have lower hydrocarbon emissions.

Both two and four-stroke engines typically consist of a crankcase, cylinder block, and cylinder head. Generally, the crankcase, cylinder block, and cylinder head need to be joined together using mechanical fasteners, thereby necessitating both additional fasteners and precisely machined fastener holes. Engines composed of separate cylinder blocks, cylinder heads, and crankcases also require sealing gaskets. These additional components add extra weight to the engines and also present greater potential for gasket failures.

To improve engine emissions while avoiding the shortcomings of engines made from separate components, it may be desirable to produce a monolithic four-stroke crankcase, cylinder block, and cylinder head. However, because four-stroke engines require an additional valve-train and valve mechanism, casting such monolithic engines is more difficult than the corresponding two-stroke engines. To overcome these challenges, monolithic cylinder blocks and crankcases have been designed having half-crank crankshafts with L-head (flat-head) valve trains, or full crankshafts with wet-type or dry-type belt driven overhead valves. As is known in the art, L-head valve arrangements provide poor fuel economy, and full crankshafts increase the weight of the engine.

SUMMARY

A monolithic four-stroke crankcase, cylinder block, and cylinder head (monolithic four-stroke cylinder crankcase) is provided. The monolithic four-stroke cylinder crankcase may include the use of a half-crank crankshaft with a dry-type belt and overhead valves. One advantage is that the half-crank crankshaft reduces both the weight and size of the cylinder crankcase. Additional details and advantages are described below.

The invention may include any of the following aspects in various combinations and may also include any other aspect described below in the written description or shown in the attached drawings.

One aspect of the present invention includes a four-stroke engine composed of a monolithic cylinder head, cylinder block, and crankcase, which includes a crank arm. The engine includes a piston that reciprocates in the cylinder and is connected to a half-crank crankshaft by a connecting rod. The engine further includes an intake valve and an exhaust valve configured to open and close a fuel intake and an exhaust outlet, respectively, and a belt connecting the crankshaft and camshaft and driving the camshaft so that it actuates the intake valve and exhaust valve.

Another aspect of the present invention includes a method of making a four-stroke engine having a monolithic cylinder crankcase. The method includes casting in a monolithic manner a cylinder head, cylinder, and crankcase that includes a crank arm containing a pocket. Inserting a half-crank crankshaft into the crankcase and crank arm; and running a belt around the crankshaft through the pocket and also around a cam shaft at the cylinder head.

BRIEF DESCRIPTION OF SEVERAL VIEWS OF THE DRAWINGS

The invention may be more fully understood by reading the following description in conjunction with the drawings.

DETAILED DESCRIPTION

Figure 1:
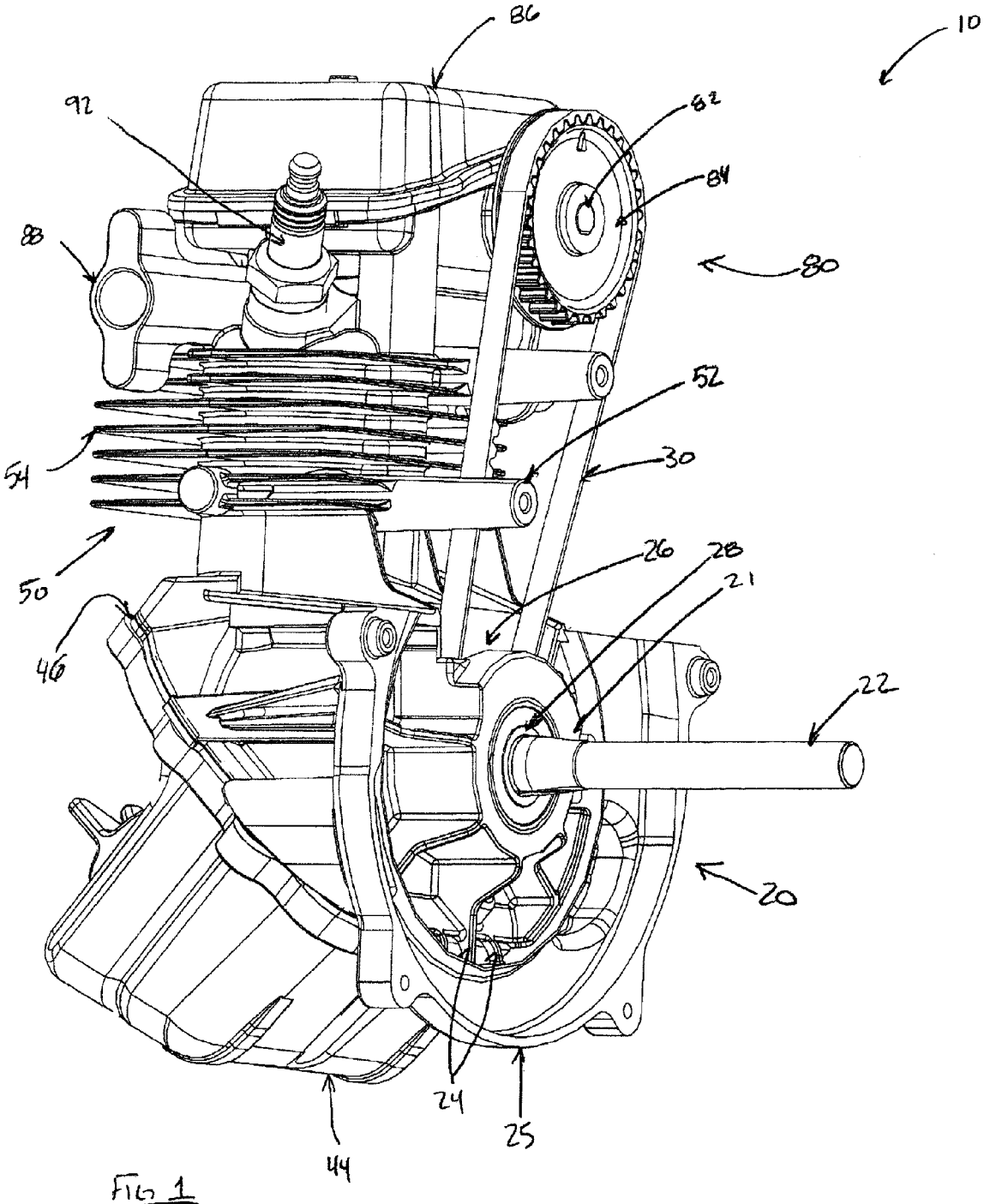
FIG. 1 is a perspective view of the assembled monolithic four-stroke cylinder crankcase with an off-set overhead cam.
Figure 2:
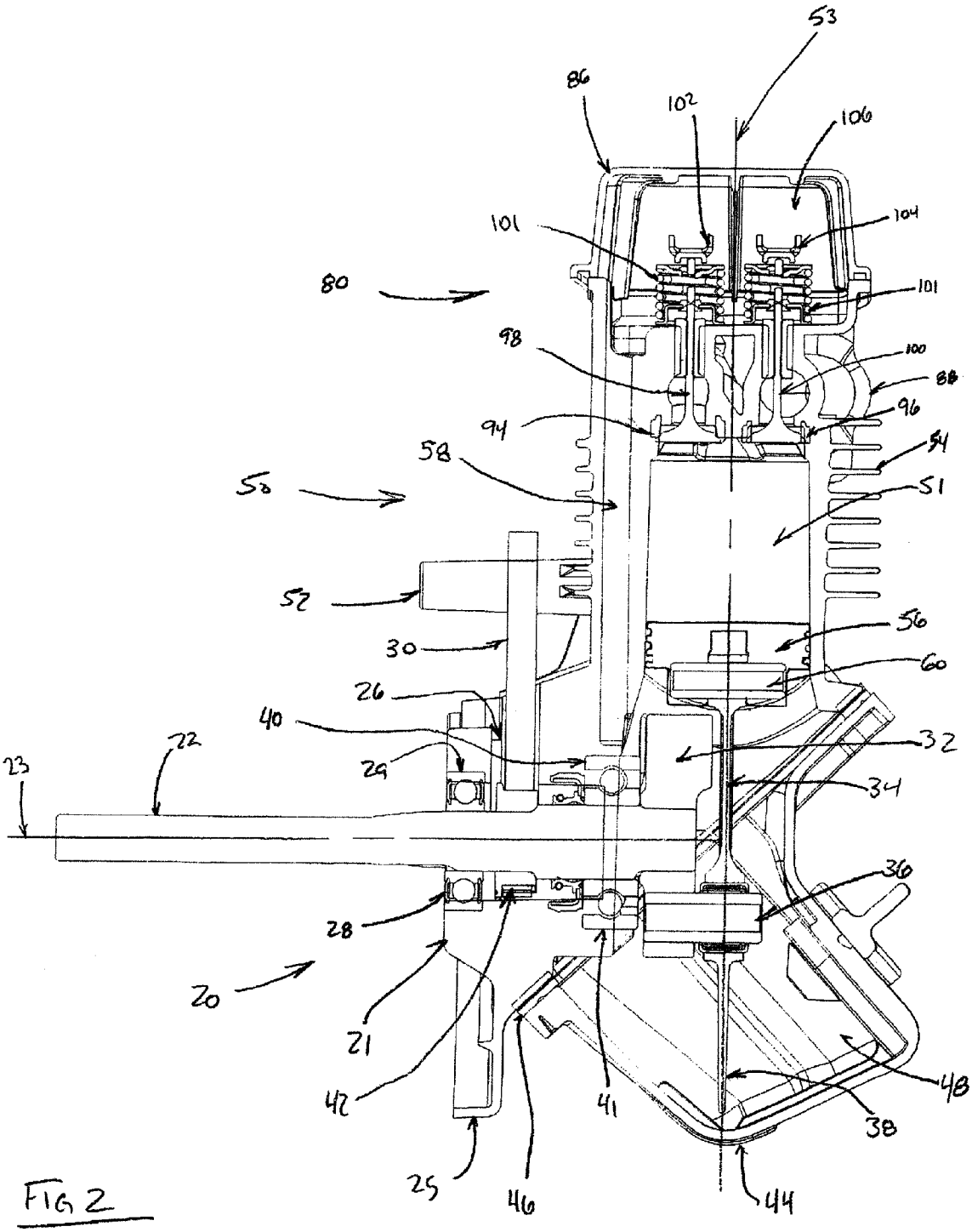
FIG. 2 is a sectional view of the assembled monolithic four-stroke cylinder crankcase.

Referring now to the drawings, it should be noted that common parts will be referred to using the same reference number throughout this Detailed Description. FIG. 1 presents a profile view of an embodiment of the engine having a monolithic cylinder crankcase 10. The monolithic four-stroke cylinder crankcase 10 includes a crankcase 20, cylinder block 50, and cylinder head 80. As can be seen in FIG. 1, the crankcase 20 includes an integrally cast crank arm 21 configured to support a crankshaft 22, a plurality of fingers 24 that connect to an outer frame 25, a pocket 26 through which a belt 30 runs, and an outer bearing 28 into which the crankshaft 22 bears. The cylinder block 50 includes a plurality of cooling fins 54 and at least one boss 52 for mounting an ignition module. As seen in FIG. 2, the cylinder block 50 also includes a cylinder 51 that generally defines a cylinder axial direction 53 from the crankcase 20 to the cylinder head 80. The cylinder head 80 includes a camshaft 82 having a cam gear 84, a valve cover 86, an exhaust passage 88, a fuel passage 90, and a spark plug 92. As shown in FIG. 1, the valve cover 86, which is mechanically fastened to the cylinder head 80, is not of uniform height. Instead, it is taller in a cylinder axial direction at one side than the other. This corresponds to the cylinder head 80 which is shorter at one side than the other. Generally, the valve cover 86 will be taller on the side with the intake and exhaust valves 98 and 100 to allow greater access to the valves 98 and 100 and valve lashes when the valve cover 86 is removed.

FIG. 2 shows a cross-sectional view of the monolithic four-stroke cylinder crankcase 10 illustrated in FIG. 1. The crankshaft 22 is rotatable within an inner bearing 40 and an outer bearing 28. Inside the crank chamber 48, a counterweight 32 is attached to the crankshaft 22. A crank pin 36 connects the crankshaft 22 and counterweight 32 to the connecting rod 34. The other end of the connecting rod 34 connects to the piston 56 via the connecting pin 60. The belt 30 passes into the crank arm 21 via the pocket 26 formed therein. The belt runs around a crank gear 42 mounted on the crankshaft 22 in the pocket 26 before emerging out of the other side of the pocket 26. The crankcase 20 is sealed by a crank cover 44 and a sealing gasket 46. The crankcase 20 and crank cover 44 define a crank chamber 48, which doubles as an oil reservoir. Opposite the connecting rod 34 on the crank pin 36 is an oil slinger 38. The oil slinger 38 distributes lubricating oil from the crank chamber 48 to the cylinder 51 as the piston 56 reciprocates inside the cylinder 51.

The cylinder block 50 also includes a passage 58 that connects the valve chamber 106 in the cylinder head 80 to the crank chamber 48, so that lubricating oil may be supplied to and return from the valve chamber 106. In some embodiments, a check valve may be included in the passage 58 to prevent the valve chamber 106 from being filled with lubricating oil when the engine is operated in an inverted position. The cylinder head 80 includes an intake valve seat 94 for an intake valve 98, and an exhaust valve seat 96 for an exhaust valve 100. The intake valve 98 is attached to an intake rocker 102, whereas the exhaust valve 100 is attached to an exhaust rocker 104. Springs 101 bias the intake rocker 102 and the exhaust rocker 104 to a closed position. Both the intake rocker 102 and exhaust rocker 104 are located in the valve chamber 106, which is defined by the void created between the valve cover 86 and the cylinder head 80.

Figure 3:
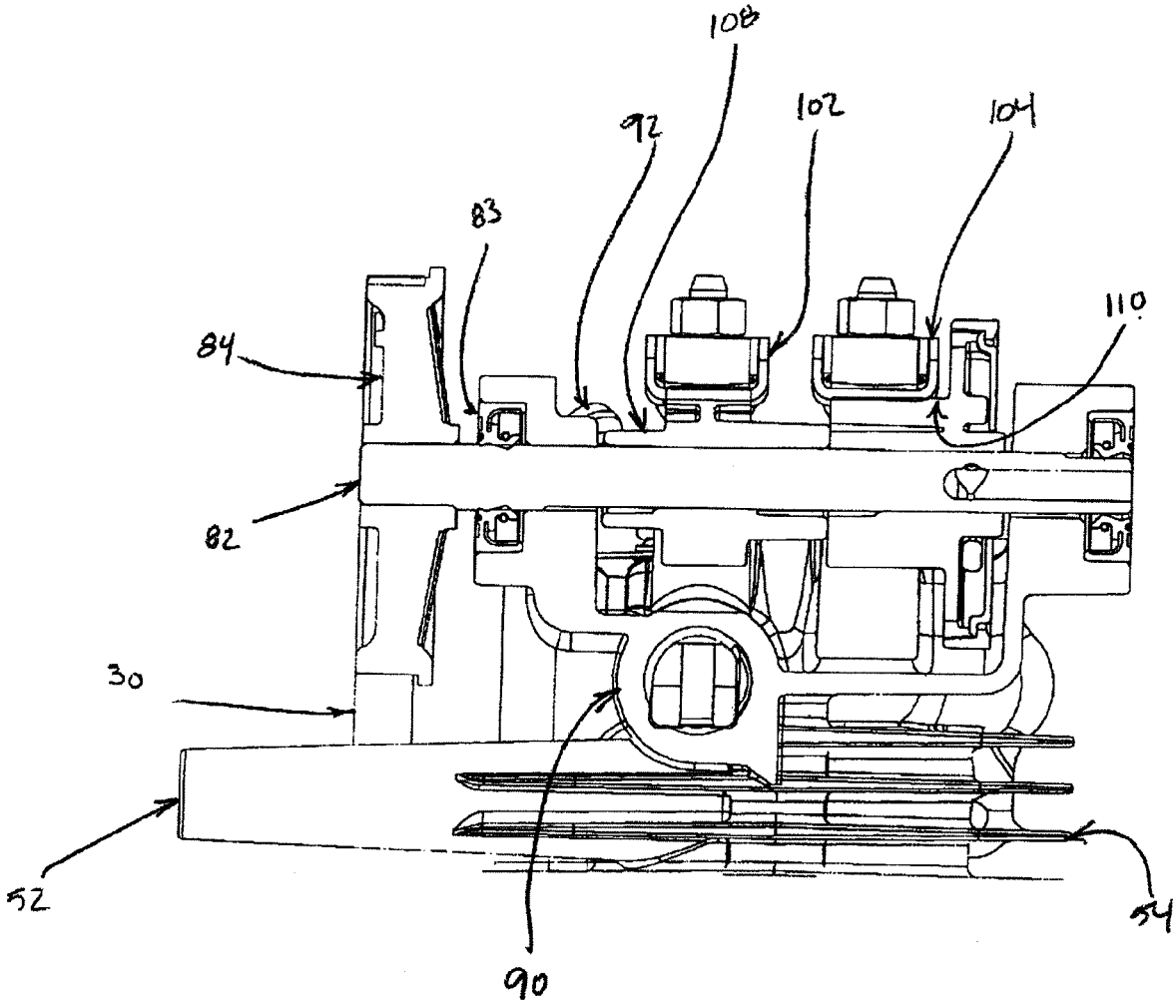
FIG. 3 is a sectional view of the valve and camshaft arrangement of one embodiment of the monolithic four-stroke cylinder crankcase.

FIG. 3 illustrates an expanded sectional view of the area surrounding the camshaft 82 and the intake and exhaust rockers 102 and 104. As can be seen, the belt 30 connects to the cam gear 84, which is placed on the cam shaft 82. The camshaft 82 includes an intake cam lobe 108 and an exhaust cam lobe 110. Depending upon the rotational position of the camshaft 82, the intake cam lobe 108 pushes against the intake rocker 102 to open the intake valve 98. The exhaust cam lobe 110 pushes against the exhaust rocker 104 to open the exhaust valve 100 when the camshaft 82 has completed about three-quarters of a rotation since opening the intake valve 98. In this particular embodiment, the bearing 83 for the camshaft 82 is confined entirely within the cylinder head 80, however it should be understood that the camshaft bearing 83 may be located so that it is partially contained in the valve cover 86 and partially in the cylinder head 80. Furthermore, it should be understood that the valve timing may be changed by adjusting the position of the intake and exhaust cam lobes 108 and 110 on the camshaft.

When the embodiment illustrated in FIGS. 1-3 is in operation, the reciprocation of the piston 56 in the cylinder 51 drives the half-crank crankshaft 22 by way of the connecting rod 34. A crank gear 42 is mounted on the crankshaft 22 in the pocket 26 in the crank arm 21 between the inner bearing 40 and the outer bearing 28. The crank gear 42 drives the belt 30. In turn, the belt 30 drives the cam gear 84. The cam gear 84 and the crank gear 82 have a gearing ratio of 1:2 so that for every rotation of the crank gear 82 the cam gear 84 makes one-half of a rotation. Thus, when the piston 56 is in a first down-stroke, the intake valve 98 is opened by the intake cam lobe 108 and intake rocker 102, to allow a fresh charge to enter the cylinder 51. The intake valve 98 closes and the piston 56 returns on an upstroke, after which the spark plug initiator and spark plug 92 fire causing combustion and a second down stroke of the piston 56. The exhaust cam lobe 110 and the exhaust rocker 104 open the exhaust valve 100 and, during the subsequent up-stroke, the piston 56 drives the exhaust from the engine.

In the embodiment shown in FIGS. 1-3, the pocket 26 through which the belt 30 runs is a cast feature formed simultaneous with the casting of the monolithic four-stroke cylinder crankcase 10. In this embodiment, the crank arm 21 includes the inner bearing 40 and the outer bearing 28. These bearings 40 and 28 may be pressed into the crank arm 21 and provide support for the crankshaft 22 and the counterweight 32 to balance the engine. The bearing bores 41 and 29 in which the inner bearing 42 and outer bearing 28 are placed are preferably cast; however, the borings may also be machined. The cast pocket 26 allows for the use of a half-crank crankshaft 22 with a dry-type belt 30. With a dry-type belt, a belt cover may be used but it is not required. Advantageously, using a dry-type belt with a half-crank crankshaft eliminates the need to enlarge the cylinder crankcase casting to form a chamber for the belt in the cylinder block, thereby reducing the weight and cost of the cylinder crankcase.

Figure 4A:
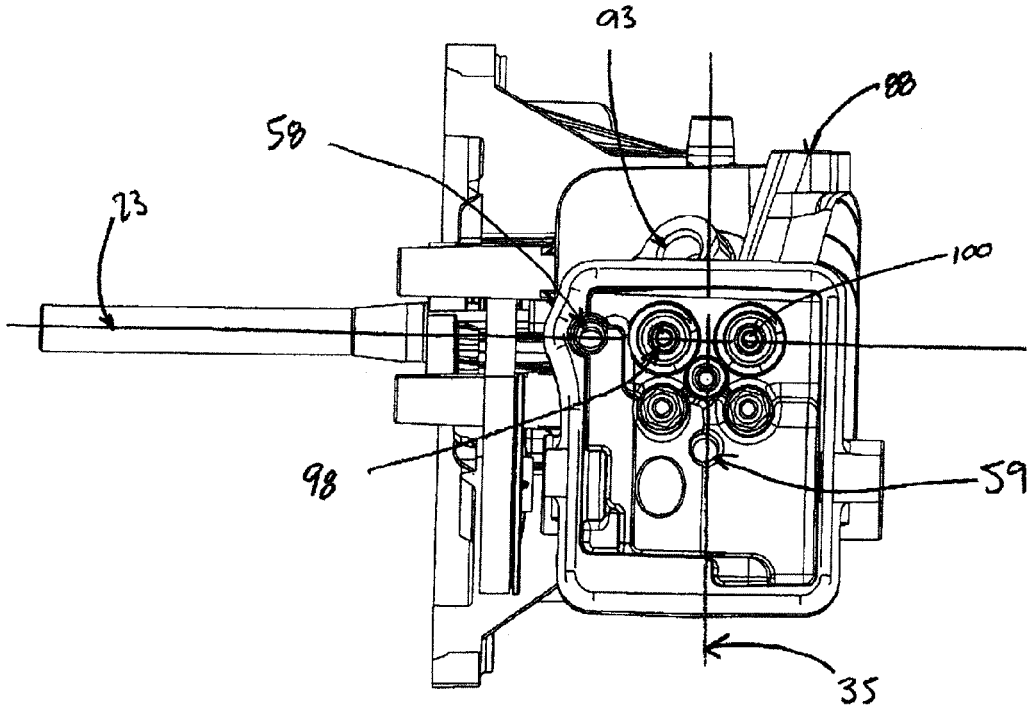
FIG. 4A is a top view of the inside of the valve chamber of one embodiment of the monolithic four-stroke cylinder crankcase.
Figure 4B:
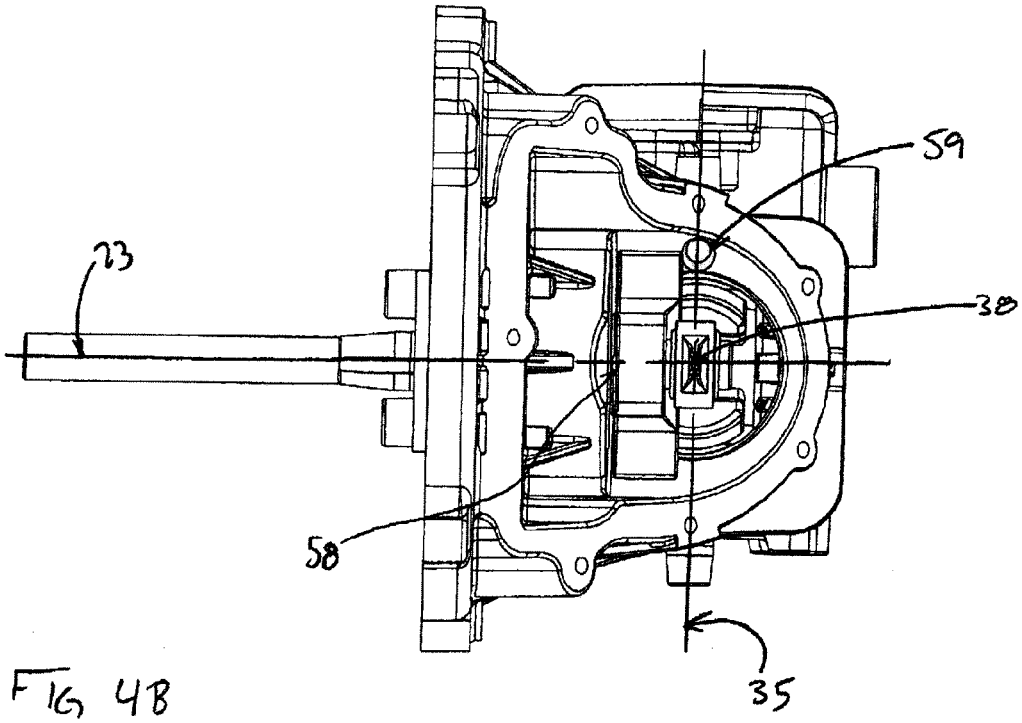
FIG. 4B is a bottom view of the inside of the crank chamber of the same embodiment as FIG. 4A.

In the embodiment of the monolithic four-stroke cylinder crankcase 10 shown in FIGS. 1-3, the engine is lubricated by the oil slinger 38. As the piston 56 reciprocates, the slinger 38, located in the crank chamber 48, is rotated so that it dips into and out of a volume of lubricating oil. As the crank pin 36 rotates about the axis of the crankshaft 22 the oil slinger 38 throws lubricating oil into the cylinder 51. As a result, a mist of oil is formed in the engine 10. As shown in FIG. 4A, the valve chamber includes two passages 58 and 59. As shown in FIG. 4B, passage 59 is placed along a central plane 35 defined by the rotation of the connecting rod 34 and opens adjacent to the connecting rod 34 in the crank chamber 48. The mist of oil formed by the slinger 38 may pass through the passage 59 into the valve chamber 106. As this mist condenses or collects in the valve chamber 106, it may flow back to the crankcase through one or both of passages 58 and 59. It should be understood that one passage 59 connecting the valve chamber 106 and the crank chamber 48 may be used, or more than two passages may be used. Furthermore, it should be understood that the oil mist may pass through either passage 58 or 59, and condensed oil may return via either passage.

As shown in FIG. 4A, the exhaust passage 88 may be placed at an angle to the plane 35 defined by the rotation of the connecting rod 34. In this embodiment, the exhaust passage 88 allows for the spark plug socket 93 to be placed adjacent to the exhaust passage. With this arrangement, the spark plug 92 may be more easily accessed. However, those skilled in the art understand that other arrangements of the spark plug socket 93 and exhaust passage 88 may be used.

To help cool the monolithic four-stroke cylinder crankcase 10, at least one opening is provided between two of the plurality of fingers 24. As noted, the plurality of fingers 24 connect the crank arm 21 to the outer frame 25. A flywheel 31, shown in FIG. 6, connects to the crankshaft 22 adjacent to the outer frame 25. The flywheel 31 may include fan elements to help pull cooling air from the side opposite the crankshaft 22, through the at least one opening, around the crankcase 20, about the outer frame 25, and to the cylinder block 50 which includes a plurality of cooling fins 54.

The monolithic four-stroke cylinder crankcase 10 also includes attachments for various engine components. The cylinder head 80 includes a connection 90 for a fuel supply system, which may consist of a carburetor. An exhaust outlet 88 that forms a connection for an exhaust pipe or muffler is also supplied. Additionally, in this embodiment, on the cylinder block 50 on the side with the crankshaft 22, at least one boss 52 is provided for connecting a spark plug initiator (not shown) such as an ignition module. It may be desirable to place the boss 52 as close to the flywheel 31 as possible to allow for better cooling of the spark plug 92 and spark plug initiator.

Figure 5:
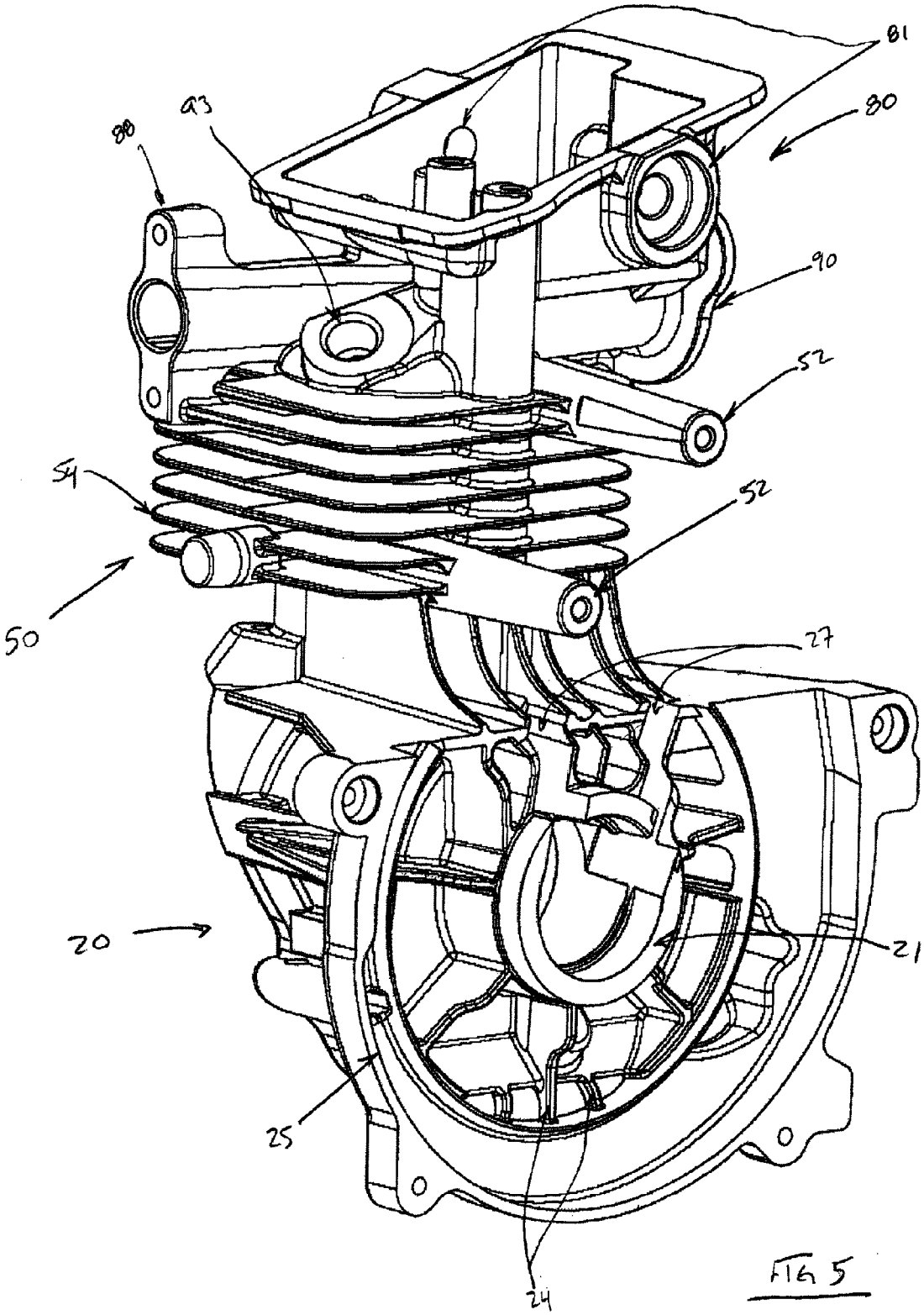
FIG. 5 is a perspective view of an alternate embodiment of the monolithic four-stroke cylinder crankcase without any additional assembled parts.

In an alternate embodiment of the present invention, shown in FIG. 5, the pocket 26 in the crank arm 21 may include a pair of slots 27. The slots 27 are cast into the crank arm 21. The slots 27 provide an opening so that the belt 30 may enter through one slot 27, pass around the crank gear 42, and then exit the pocket 26 through the other slot 27. Advantageously, the slots 27 may simplify the casting of the monolithic four-stroke cylinder crankcase 10. FIG. 5 also shows the bearing 81 for the camshaft 82 in the cylinder head 80. Additionally, the socket 93 for the spark plug is shown adjacent to the exhaust passage 88.

Figure 6:
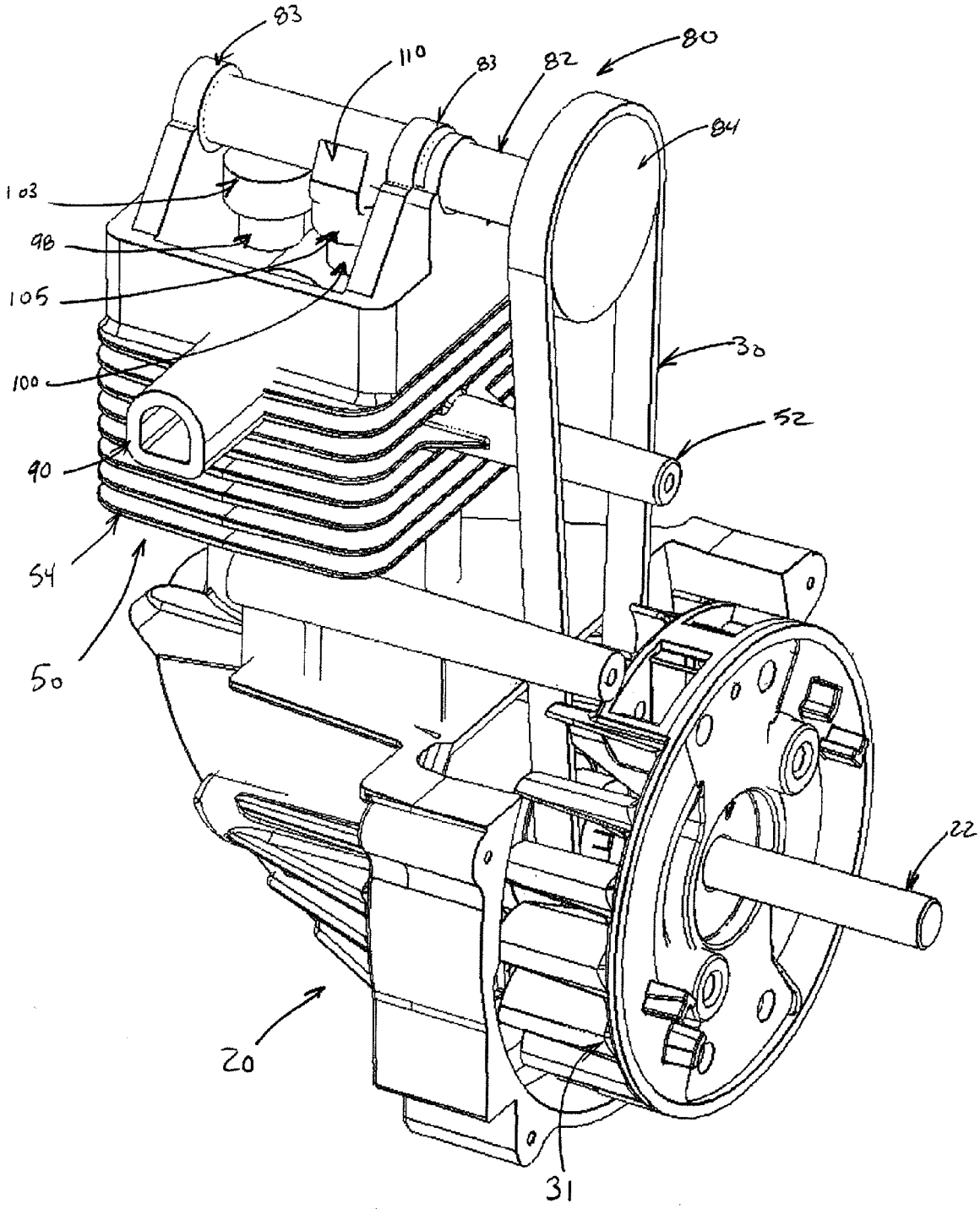
FIG. 6 is a perspective view of another embodiment of the assembled monolithic four-stroke cylinder crankcase with a centered overhead camshaft.

As shown in FIG. 6, the camshaft 82 may be placed in the cylinder head 80 in a plane defined by the axis 53 of the cylinder 51 and the axis 23 of the crankshaft 22, as opposed to offset from this plane as in FIGS. 1-3. Furthermore, as shown, the camshaft bearings 83 can be located so that they are contained partially in the cylinder head 83 and partially in the valve cover 86. In this embodiment, the intake cam lobe 108 and the exhaust cam lobe 110 are formed monolithically with the camshaft 82. However, the cam lobes 108 and 110 need not be monolithically formed as part of the camshaft 82, but could be attached to the camshaft 82. In place of intake rocker 102 and exhaust rocker 104, an intake cam follower 103 and an exhaust cam follower 105 are used. In operation, the camshaft 82 is driven by the belt 30 as described above. The intake cam lobe 108 depresses the intake cam follower 103, and then after about three-quarters of a revolution of the camshaft 82 the exhaust cam lobe 110 depresses the exhaust cam follower 105. In this manner, the intake valve 98 and exhaust valve 100 are opened and closed at the appropriate times. It should be understood that the valve timing may be changed by adjusting the positions of the cam lobes 108 and 110.

Figure 7:
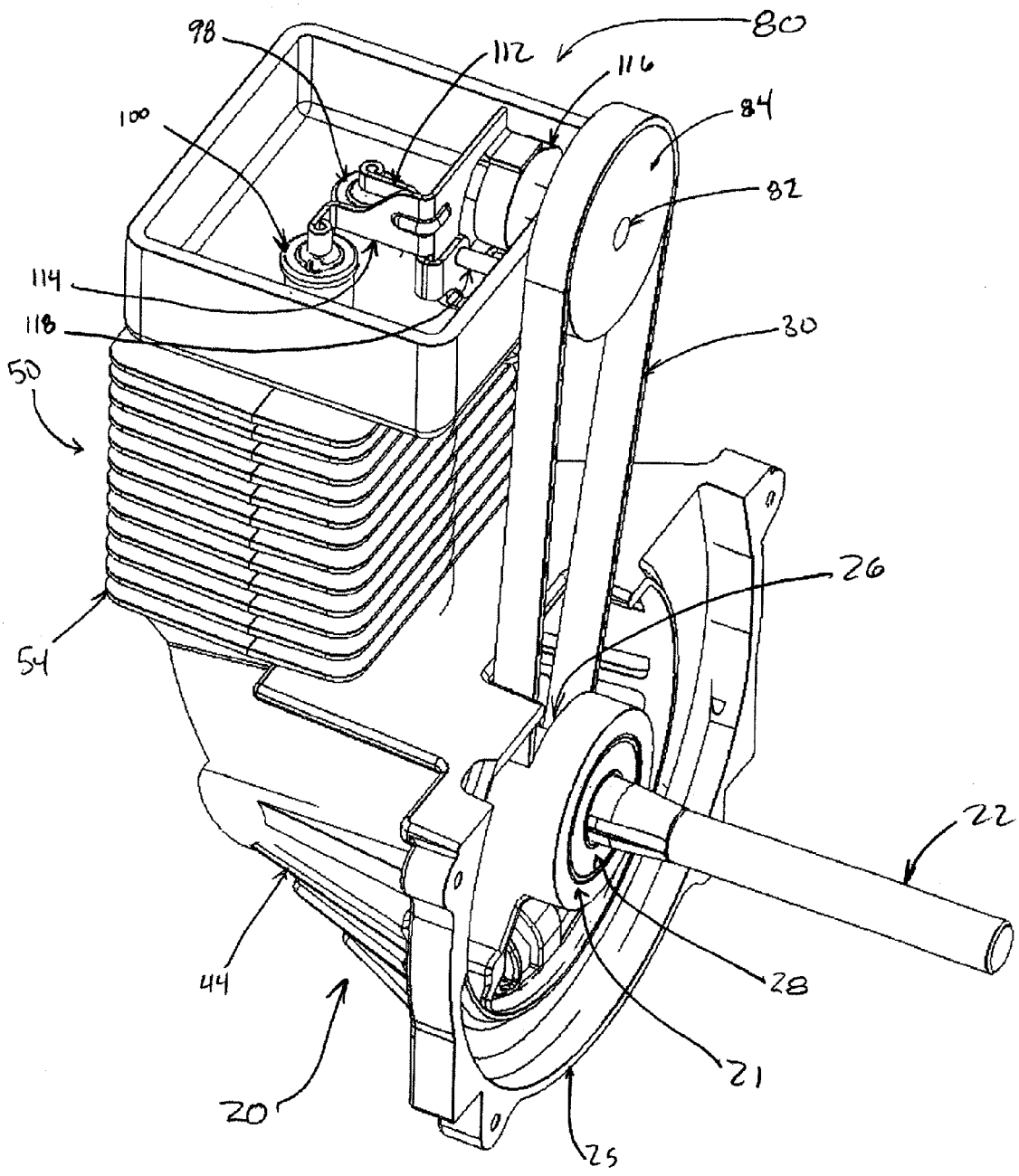
FIG. 7 is a perspective view of another embodiment of the monolithic four-stroke cylinder crankcase with an off-set overhead camshaft.
Figure 8:
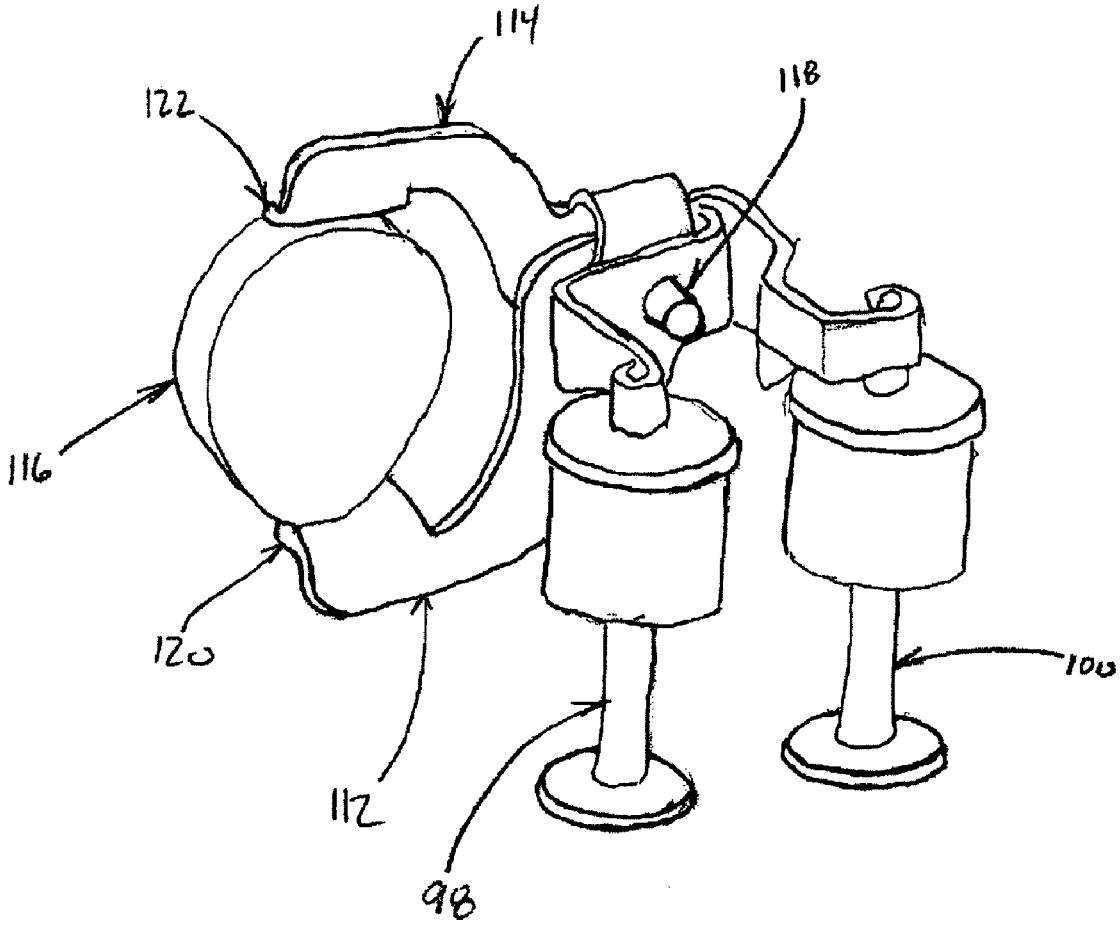
FIG. 8 is an isolated view of an embodiment having rocker arms and a single cam arrangement for use in the monolithic four-stroke cylinder crankcase.

An alternate embodiment is illustrated in FIGS. 7 and 8. In this embodiment, the monolithic four-stroke cylinder crankcase 10 has an open pocket 26 through which the belt 30 passes. Additionally, the monolithic four-stroke cylinder crankcase has an offset camshaft 82 with only one cam lobe 116. The cam lobe 116 activates both the intake rocker arm 112 and the exhaust rocker arm 114. FIG. 8 shows an isolated view of the cam lobe 116, the intake rocker arm 112, the exhaust rocker arm 114, the intake valve 98, and the exhaust valve 100. The intake rocker arm 112 includes an intake contact element 120 near the cam lobe 116, while the exhaust rocker arm 114 includes an exhaust contact element 122 near the cam lobe 116. The intake rocker arm 112 and the exhaust rocker arm 114 may be made from a variety of materials, for example stamped metal. In the embodiment shown in FIGS. 7 and 8, for every half revolution of the camshaft 82, the cam lobe 116 drives either the exhaust rocker arm 114 up, or the intake rocker arm 112 down. When pushed by the cam lobe 116, the intake rocker arm 112 rotates about the rocker pivot pin 118. This pivoting causes the intake rocker arm 112 to push down and open the intake valve 98. Similarly, when the exhaust rocker arm 116 is contacted by the cam lobe 116, the exhaust rocker arm 114 pivots about the rocker pivot pin 118 and pushes on and opens the exhaust valve 100. Advantageously, this rocker arrangement eliminates one of the cam lobes from a traditional camshaft. It should be understood that the valve timing can be changed by adjusting the locations of the intake contact element 120 and exhaust contact element 122 relative to one another and about the circumference of the cam lobe 116.

The monolithic four-stroke cylinder crankcase described above may be integrally cast as a single piece. Typically, the monolithic four-stroke cylinder crankcase is made using a die-cast injection molding process. However, other means of casting may be used. In one embodiment, the monolithic four-stroke cylinder crankcase is made of an aluminum alloy, and more particularly from a high silicon aluminum alloy. However, the monolithic four-stroke cylinder crankcase may be made of any suitable metal able to withstand the elevated combustion temperatures, such as steel, aluminum, iron, or magnesium. Depending upon the material used, the cylinder may be plated using, for example, chromium or nickel silver (nickelsil). Alternatively, the cylinder may not be plated but instead the piston may be plated.

While several embodiments of the invention have been described, it should be understood that the invention is not so limited, and modifications may be made without departing from the invention. The scope of the invention is defined by the appended claims, and all devices that come within the meaning of the claims, either literally or by equivalence, are intended to be embraced therein. Furthermore, the advantages described above are not necessarily the only advantages of the invention, and it is not necessarily expected that all of the described advantages will be achieved with every embodiment of the invention.

The invention claimed is:

1. A four-stroke cylinder crankcase comprising:

a monolithic cylinder head, cylinder block having a cylinder, and crankcase that includes a crank arm;

a piston for reciprocating in the cylinder;

a connecting rod;

a half-crank crankshaft in the crankcase, wherein the piston is connected to the crankshaft by the connecting rod;

an intake valve in the cylinder head and configured to open and close a fuel intake into the cylinder;

an exhaust valve in the cylinder head and configured to open and close an exhaust outlet from the cylinder;

a camshaft configured to actuate the intake valve and the exhaust valve; and a belt connecting the crankshaft and the camshaft.

2. The four-stroke cylinder crankcase of claim 1 further comprising:

an inner bearing in the crank arm configured to support the crankshaft;

an outer bearing in the crank arm configured to support the crankshaft; and a pocket between the inner bearing and the outer bearing, wherein the belt rotates within the pocket.

3. The four stroke cylinder crankcase of claim 2 wherein a portion of the belt enters the pocket through a first slot in the crank arm and another portion of the belt exits the pocket through a second slot in the crank arm.

4. The four-stroke cylinder crankcase of claim 1 further comprising:

an intake rocker attached to the intake valve and an exhaust rocker attached to the exhaust valve; and an intake cam lobe and an exhaust cam lobe located on the camshaft, and configured to actuate the intake rocker and the exhaust rocker, respectively.

5. The four-stroke cylinder crankcase of claim 1 further comprising:

an intake rocker arm attached to the intake valve and to a pivot pin and having an intake contact element;

an exhaust rocker arm attached to the exhaust valve and to the pivot pin and having an exhaust contact element; and a cam lobe on the camshaft, wherein the cam lobe is in the cylinder head;

wherein as the camshaft rotates the cam lobe alternately actuates (i) the intake rocker arm by pushing the intake contact element to open the intake valve, and (ii) the exhaust rocker arm by pushing the exhaust contact element to open the exhaust valve.

6. The four stroke cylinder crankcase of claim 1 further comprising:

an intake cam follower attached to the intake valve;

an exhaust cam follower attached to the exhaust valve; and an intake cam lobe and an exhaust cam lobe located on the camshaft, and configured to depress the intake cam follower and exhaust cam follower respectively.

7. The four-stroke cylinder crankcase of claim 1 wherein a bearing for the camshaft is located entirely in the cylinder head.

8. The four-stroke cylinder crankcase of claim 1 further comprising a valve cover attached to the cylinder head and having a first end and a second end with the first end being taller in a cylinder axial direction than the second end.

9. The four-stroke cylinder crankcase of claim 8 wherein the first end of the valve cover is taller in the cylinder axial direction than the second end, and the first end corresponds to the side of the cylinder head in which the intake and exhaust valves are located.

10. The four-stroke cylinder crankcase of claim 1 wherein the camshaft is located in a position in the cylinder head offset from a plane defined by an axis of the cylinder and an axis of the crankshaft.

11. The four-stroke cylinder crankcase of claim 1 further comprising a valve cover attached to the cylinder head to define a valve chamber between an inside surface of the valve cover and the cylinder head, wherein the valve chamber and the crankcase are in fluid communication.

12. The four-stroke cylinder crankcase of claim 11 further comprising an oil passage with a first end opening into the crankcase and a second end opening into the valve chamber, and wherein the first end is located such that it is bisected by a plane defined by the rotation of the connecting rod.

13. The four-stroke cylinder crankcase of claim 1 wherein an inner wall of the cylinder is plated.

14. The four-stroke cylinder crankcase of claim 1 further comprising a plurality of fingers connecting the crank arm to an outer frame, wherein an opening is formed between at least two of the plurality of fingers to facilitate the passage of cooling air to the cylinder block.

15. The four-stroke cylinder crankcase of claim 1 wherein the monolithic cylinder head, cylinder, and crankcase further comprises a boss for mounting a spark plug initiator.

16. The four-stroke cylinder crankcase of claim 15 wherein the boss is placed adjacent to a flywheel.

17. The four-stroke cylinder crankcase of claim 1 wherein the crankshaft includes an oil slinger for distributing lubricating oil.

18. A method of making a four-stroke cylinder crankcase comprising:

constructing a cylinder head, cylinder, and crankcase as a single monolithic piece, and wherein the crankcase includes a crank arm and the crank arm includes a pocket;

inserting a half-crank crankshaft into the crankcase and the crank arm; and passing a belt around the crankshaft through the pocket and around a cam shaft at the cylinder head.

19. The method of claim 18 wherein the cylinder head, cylinder, and crankcase are die cast.

20. The method of claim 18 wherein the cylinder head, cylinder and crankcase are injection molded.

21. The method of claim 18 further comprising constructing the pocket to include a first slot and a second slot, wherein a portion of the belt passes through each of the first and second slots.

22. The method of claim 18 further comprising fashioning a boss for mounting an ignition module.

* * * * *